United States Patent [19]

Van Benthem et al.

[11] 4,277,717

[45] Jul. 7, 1981

[54] LOW-PRESSURE SODIUM VAPOR DISCHARGE LAMP

[75] Inventors: Willem Van Benthem; Robertus L. C. De Vaan, both of, Eindhoven, Netherlands

[73] Assignee: U.S. Philips Corporation, New York, N.Y.

[21] Appl. No.: 95,129

[22] Filed: Nov. 15, 1979

[30] Foreign Application Priority Data

Nov. 17, 1978 [NL] Netherlands ..... 7811350

[51] Int. Cl.[3] ..... H01J 61/16; H01J 61/22

[52] U.S. Cl. ..... 313/226; 313/225

[58] Field of Search ..... 313/226, 485, 486, 487

[56] References Cited

U.S. PATENT DOCUMENTS

| | | | |
|---|---|---|---|
| 3,886,393 | 5/1975 | Hinson | 313/226 X |
| 4,032,814 | 6/1977 | Shurgan et al. | 313/226 X |

*Primary Examiner*—Palmer C. Demeo
*Assistant Examiner*—Darwin R. Hostetter
*Attorney, Agent, or Firm*—Robert S. Smith

[57] ABSTRACT

A low-pressure sodium vapor discharge lamp having a tubular discharge vessel (1) not more than 400 mm long and not more than 20 mm in diameter, which contains anexcess of sodium, helium and at least one of the rare gases neon, argon, krypton and xenon. The object of the invention is to provide a small low-pressure sodium vapor discharge lamp which has a lower power consumption than a similar known lamp. The composition of the rare gas filling present in the discharge vessel is defined by a quadrilateral AB CD in a ternary volume composition diagram PQR shown in FIG. 1, where P represents He, Q represents Ne and/or A and R represents Kr and/or Xe. A denotes a mixture consisting of 80% by volume of He and 20% by volume of Ne, B denotes a mixture consisting of 95% by volume of He and 5% by volume of Kr and/or Xe, C denotes a mixture consisting of 50% by volume of He and 50% by volume of Kr and/or Xe, and D denotes a mixture consisting of 25% by volume of He and 75% by volume of Ne and/or A.

2 Claims, 3 Drawing Figures

LOW-PRESSURE SODIUM VAPOR DISCHARGE LAMP

The invention relates to a low-pressure sodium vapor discharge lamp comprising a discharge tube at the ends of which electrodes are present, said tube having a length of not more than 40 cm and a diameter of not more than 20 mm and an outer bulb enveloping this discharge tube, an excess of sodium as well as a mixture of rare gases being present in the discharge tube. Such a lamp is disclosed in the Netherlands Patent Application No. 7611993 which has been laid open to public inspection.

The above-mentioned known small low-pressure sodium vapor discharge lamp is a light source of a type which converts electric energy into visible radiation with a high efficiency. The power consumed by the lamp is relatively low. This known lamp may be particularly suitable as light source for security illumination, for example on the outside of garages or on factory sites.

For a number of uses of this lamp it is desirable that the consumed power is as low as possible.

The quantity of electric power consumed by the lamp can be limited for example by reducing the volume of the discharge tube, or by reducing the electrode spacing. However, these measures have the drawback that the efficiency of the conversion of electric power into visible light in the discharge tube decreases. In addition, when the electrode spacing is reduced, a reduction of the arc voltage and an increase of the current strength occurs for a given lamp power so that the efficiency of the combination of the lamp and the electric stabilization ballast is reduced. Furthermore, reducing the dimensions of the discharge tube requires additional measures during fabrication of the lamp, for example during the sealing process of the electrodes into the discharge tube.

It is an object of the invention to provide a low-pressure sodium vapor discharge lamp whose consumed electric power is less than that of a similar above-mentioned known lamp, it not being necessary to alter the shape and the dimensions of the lamps.

According to the invention this object is accomplished by means of a low-pressure sodium vapor discharge lamp of the type mentioned in the preamble, which is characterized in that the rare gas mixture present in the discharge vessel comprises helium and at least one of the elements neon, argon, krypton and xenon, it being possible to represent the composition of the rare gas mixture by means of points located on or within the rectangle ABCD in the ternary volume composition diagram PQR, P representing helium, Q neon and/or argon and R representing krypton and/or xenon, A denoting a mixture 80% by volume of helium and 20% by volume of nenon and/or argon, B denoting a mixture consisting of 95% by volume of helium and 5% by volume of krypton and/or xenon, C denoting a mixture consisting of 50% by volume of helium and 50% by volume of krypton and/or xenon and D denoting a mixture consisting of 25% by volume of helium and 75% by volume of neon and/or argon.

Figure 1:
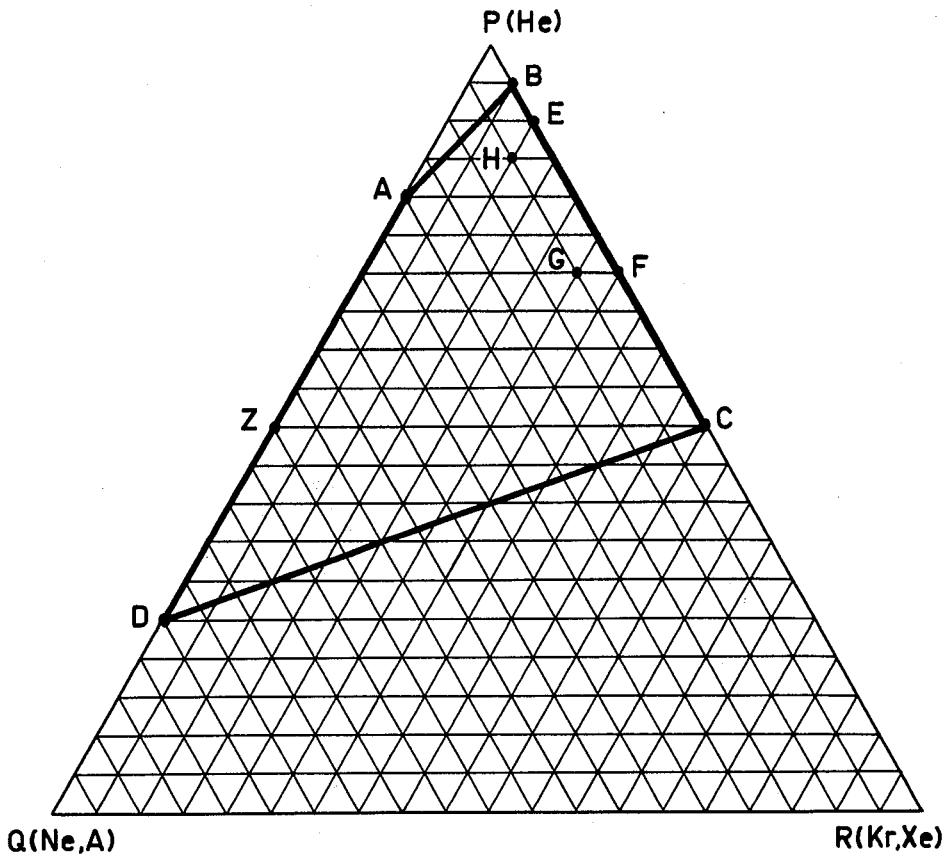

FIG. 1 of the drawing shows the ternary volume composition diagram PQR. In this diagram, which is in the shape of a triangle having vertices P, Q and R, all mixtures composed of the rare gas combination of (1) helium, (2) neon and/or argon and (3) krypton and/or xenon can be represented by means of a point in this diagram. The mixtures consisting of helium with argon and/or neon are shown in the diagram on the side PQ. For example, the mixture consisting of 50% by volume of He, 25% by volume of A and 25% by volume of Ne as well as the mixture consisting of 50% by volume of He and 50% by volume of Ar, are both represented by the same point (point Z). The mixtures on the basis of helium with krypton and/or xenon are on the side PR and the mixtures consisting of neon and/or argon with krypton and/or xenon are on the side QR. The other mixtures are located within the triangle PQR. The mixture is represented by a point within or on the triangle. Such a point represents unambiguously the percentage of He in the diffeent mixtures. The points located on or within the rectangle ABCD represent the compositions of the mixtures according to the invention.

A lamp according to the invention has a consumed power which is less than that of a known lamp which is otherwise similar except in respect of the rare gas content, the efficiency of the conversion in the discharge vessel of electric power into visible light being maintained. The shape and the dimensions of the discharge vessel need not be altered. Compared with a lamp as described in the above-mentioned Netherlands patent application, it appeared that the electric power consumed by the lamp was approximately 25% lower. At the known high discharge efficiency of the low-pressure sodium vapor discharge lamps the luminous efficacy was proportionally lower but still amply sufficient for the purposes for which the above-mentioned lamps are usable.

The ratios between the rare gases which form part of the mixture influence the quantity of electric power consumed. If the percentage of helium compared with the heavier rare gas is too large, a pronounced decrease of the consumed power occurs (compared with the known lamps) and then the above-mentioned conversion efficiency in the discharge vessel decreases so much, that the luminous flux of the lamp becomes unacceptably low. If, on the contrary the percentage of helium in the rare gas mixture is too small, there is no worthwhile reduction in the power consumption of the lamp.

Very satisfactory results were obtained by means of a lamp according to the invention wherein the discharge vessel comprises a rare gas mixture the composition of which is shown at or within rectangle EFGH in the ternary diagram. Herein E denotes a mixture consisting of 90% by volume of He with 10% by volume of Kr and/or Xe, F denotes a mixture consisting of 70% by volume of He and 30% by volume of Kr and/or Xe. The points G and H denote mixtures corresponding respectively to E and F, but which there are small quantities (up to 5% by volume) of A and/or Ne.

Figure 2:
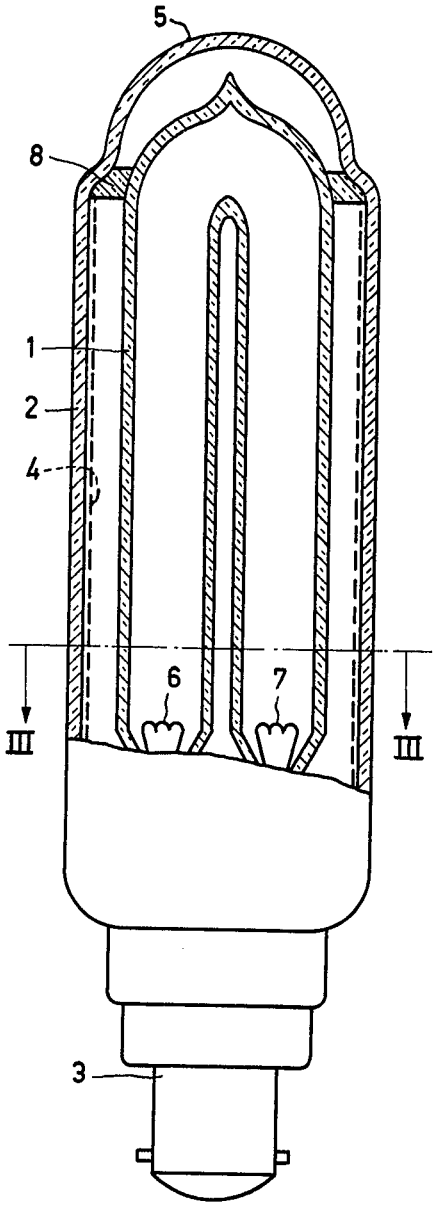
Figure 3:
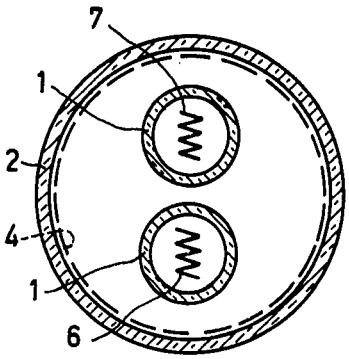

An embodiment of a lamp according to the invention will be further explained with reference to a drawing in which FIG. 1 shows schematically the ternary diagram PQR discussed above and FIG. 2 shows schematically a side elevation partly in cross-section of a low-pressure sodium vapor discharge lamp according to the invention, FIG. 3 shows a cross-section in the plane II—II of the lamp of FIG. 2.

Referring to FIG. 2, a U-shaped discharge tube 1 is enveloped by an outer bulb 2. This outer bulb 2 has the form of a circular cross-sectioned cylinder. The lamp has a lamp base 3 which is provided with connecting elements for the electric connection of the lamp. The inner wall of the outer bulb 2 is provided with an indium oxide layer 4 which transmits sodium light but reflects infra-red radiation. This layer is indicated by means of a broken line in FIG. 2 and 3 and is approximately 0.5 micron thick. A hemispherical end-piece 5 is disposed at that end of the outer bulb 2 which is remote from the lamp base 3. Electrodes 6 and 7 disposed, one at each end of the U-shaped discharge tube 1. A metal element 8 supports the bend of the discharge tube 1 relative to the outer bulb 2. In FIG. 3 the same reference numerals are used for the same components as in FIG. 2. In a practical embodiment of a low-pressure sodium vapor discharge lamp according to the invention, the overall length of the lamp is approximately 20 cm. The diameter of the outer bulb 2 is approximately 5 cm. The diameter of each of the legs of the discharge tube 1 is approximately 1,5 cm. Besides an excess of sodium (approximately 140 mg), the discharge tube 1 also comprises a quantity of a rare gas mixture, namely 85% helium and 15% krypton (in a percentage by volume) at a pressure of 2 Torr (at the operating temperature). The luminous flux of this lamp was approximately 1400 lumen. At an arc voltage of 100 V and a current strength of 170 mA, the power consumed by the lamp was 13,5 Watt. The power consumed by the lamp and the electric stabilization ballast together was 18 Watt.

What is claimed is:

1. A low-pressure sodium vapor discharge lamp comprising a discharge tube, at the ends of which electrodes are present said tube having a length of not more than 40 cm and a diameter of not more than 20 mm and an outer bulb enveloping this discharge tube, a mixture of rare gases being present in the discharge tube besides an excess of sodium, characterized in that the rare gas mixture comprises helium and at least one of the elements neon, argon, krypton and xenon, the composition of the rare gas mixture being represented by means of points located on or within the rectangle ABCD in the ternary volume composition diagram PQR, P representing helium, Q neon and/or argon and R representing krypton and/or xenon, A denoting a mixture consisting of 80% by volume of helium with 20% by volume of neon and/or argon, B denoting a mixture consisting of 95% by volume of helium with 5% by volume of krypton and/or xenon, C denoting a mixture consisting of 50% by volume of helium with 50% by volume of krypton and/or xenon and D denoting a mixture consisting of 25% by volume of helium with 75% by volume of neon and/or argon.

2. A low-pressure sodium vapor discharge lamp as claimed in claim 1, characterized in that the discharge tube comprises a mixture of rare gases whose composition is shown on or within the rectangle EFGH in the ternary diagram.

* * * * *